United States Patent [19]

Golichowski

[11] Patent Number: 4,753,018

[45] Date of Patent: Jun. 28, 1988

[54] MULTIVENT SYSTEM FOR DRYER EXHAUST

[75] Inventor: Gary D. Golichowski, Lincoln Township, Berrien County, Mich.

[73] Assignee: Whirlpool Corporation, Benton Harbor, Mich.

[21] Appl. No.: 924,309

[22] Filed: Oct. 29, 1986

[51] Int. Cl.[4] ..... F26B 25/12

[52] U.S. Cl. ..... 34/133; 29/418; 72/335; 220/226; 413/15; 174/65 R

[58] Field of Search ..... 174/65 R, ; 220/266; 29/413, 414, 418, 520, 522, 416; 72/335; 413/12, 15; 34/133

[56] References Cited

U.S. PATENT DOCUMENTS 3,152,715 10/1964 Daniels ..... 220/266

*Primary Examiner*—Larry I. Schwartz

*Attorney, Agent, or Firm*—Hill, Van Santen, Steadman & Simpson

[57] ABSTRACT

A method of making a knockout plug in a sheet of metal is provided. The method comprises the steps of: shearing the sheet metal along a majority of a perimeter of a geometric shape so that a plug is produced retained to the sheet metal by at least one retaining strip; cold working at least one sheared area at a pressure sufficient to cause the sheared sheet metal in the area to coalesce; and shearing the retaining strip so that the sheet metal has been sheared along the entire perimeter of the geometric shape. An appliance having a metal casing and a knockout plug stamped in the casing for providing a vent in the cabinet is also provided. The knockout plug is fully sheared along its entire perimeter and has an area along its perimeter that has been cold worked to produce coalesce between the sheared metal.

19 Claims, 2 Drawing Sheets

MULTIVENT SYSTEM FOR DRYER EXHAUST

BACKGROUND OF THE INVENTION

1. Field of the Invention

The present invention relates to clothes dryers and more particularly to knockout plugs for venting the dryer exhaust.

2. Description of the Prior Art

In clothes dryers, a source of heat sufficient to dry the wet clothes in the dryer is drawn through the dryer by a blower. After the heat has been drawn through the dryer containing the clothes it is necessary to vent the heated air. To this end, an air exhaust conduit is provided that extends from within the cabinet of the dryer to an area outside the dryer. For example, it is known to extend the air exhaust conduit from the cabinet to a window so that the heated air is vented outdoors.

Due to the construction of the basement or other location where the consumer may locate the dryer it may be necessary or desirable to extend the air exhaust conduit from a specific side of the dryer. Accordingly, it is desirable to provide the consumer with a method for venting the air exhaust conduit from either side or the back of the dryer. To this end, knockout plugs in the dryer cabinet have been developed. A knockout plug is a portion of the painted cabinet that has been constructed so that the consumer can remove the plug creating a vent in the dryer through which the air exhaust conduit can be extended.

For example, it is known to stamp the sheet metal from which the metal casing of the cabinet is constructed along a majority of a circumference of a circle leaving a retaining strip. This creates a knockout plug that is sheared along a majority of the circumference of the circle, but, however is still secured to the remaining portions of the metal casing by the retaining strip. To create an opening or vent, the consumer exerts a sufficient force on the knockout plug fracturing the retaining strip. However this construction is not entirely satisfactory. Typical stamped steel exhaust vent knockout plugs are not easy to remove and damage to the side panels of the dryer while removing the plug is a common occurrence. In order to remove the knockout plug it is necessary to fracture the retaining strip. This requires that a sufficiently large force be exerted thereagainst. The force necessary to fracture a retaining strip to equal to the actual failure stress. Due to the large force that must be exerted to remove the plug, damage to the paint and side panels typically occurs.

It has been known to utilize plastic insert plugs instead of knockout plugs that are stamped out of the metal casing. To this end, a hole is stamped in the metal casing and a plastic insert plug is inserted therein. Although the plastic insert plug provides a vent plug that is easier to remove than typical stamped steel exhaust vent plugs it suffers the disadvantage of not being color matched to the dryer. As previously stated, one of the advantages of exhaust vent plugs is that it allows the consumer to vent the air exhaust conduit from either side of the cabinet. Accordingly, one of the knockout plugs will typically not be removed. Therefore, the knockout plug must also provide an aesthically pleasing construction since it will typically form a part of the cabinet. Moreover, plastic insert plugs are usually more expensive than stamped knockout plugs.

Thus, it would be advantageous to provide an easy to remove knockout plug that is stamped out of the sheet metal from which the metal casing is created.

SUMMARY OF THE INVENTION

The present invention provides a dryer having a cabinet and a flexible duct means within the cabinet providing air flow communication between a blower and any one of a plurality of knockout plug venting locations in the cabinet. Further, the invention provides a knockout plug that requires less force to remove than conventional stamped steel knockout plugs and a method of making same. The method comprises: shearing the sheet metal that will comprise the metal casing along the majority of a perimeter of a geometric shape so that a plug is produced that is retained to the sheet metal by at least one retaining strip; cold working at least one sheared area at a pressure sufficient to cause the sheared metal in the area to coalesce; and then shearing the retaining strips so that the sheet metal has been sheared along the entire perimeter of the geometric shape. Preferably, the sheet metal is sheared in the first step to produce a plurality of retaining strips and the knockout plug is cold worked along the perimeter of the knockout plug between the retaining strips. Most preferably, the sheet metal is stamped so that the knockout plug has a circular shape.

An appliance having a metal casing and knockout plug stamped in the casing for providing an opening in the cabinet is also provided. The knockout plug is fully sheared along its entire perimeter and has an area along the perimeter that has been cold worked to cause the sheared metal to coalesce. Preferably, a knockout plug is located on each side of the appliance and on the back of the appliance.

Due to its construction, the knockout plug of the present invention is easier to remove than conventional stamped steel knockout plugs. Accordingly, little or no damage should occur to the cabinet as the knockout plug is removed. Moreover, the force required to remove the plug is variable and can be controlled by the number of points along the perimeter of the knockout plug that are subjected to cold working.

DETAILED DESCRIPTION OF THE PREFERRED EMBODIMENTS

Figure 1:
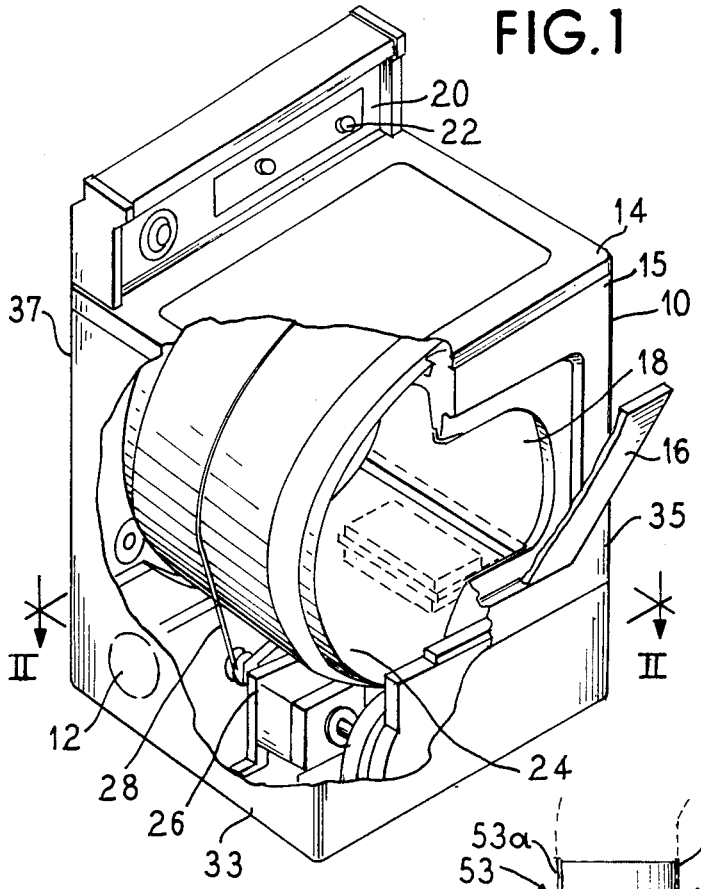
FIG. 1 illustrates a perspective view of a dryer with parts broken away having the knockout plug of the present invention.

FIG. 1 illustrates a dryer 10 including the knockout plug 12 of the present invention. The dryer 10 comprises a cabinet 14 having a front panel 15 with an openable door 16 revealing an access opening 18. A console 20 having presettable controls 22 thereon allows an operator to preselect a program of automatic drying and tumbling in a laundry drying process. The door 16 and the front panel 15 of the cabinet 14 permits access through the access opening 18 into the interior of a drum 24 having open ends which is rotatably mounted within the cabinet 14.

Below the drum 24 but within the cabinet 14 there is provided an electric motor 26 which rotatably drives the drum by means of a belt 28 and also drives a blower 29. The blower 29 circulates heated air into the drum 24 which is used in the drying process. The blower has a housing 29*a* which forms a first duct means 29*b*. The heated air that has been used in the drying process is vented from the blower duct means 29*b* through an air exhaust duct or conduit 31. The air exhaust conduit 31 is a flexible and expandable tube comprising a coiled metal wire 31*a* with a thin flexible plastic or sheet metal sidewall covering 31*b*. The flexible duct 31 is connected at a first end to first duct means 29*b*. The opposite or second end of the flexible duct 31 is connected to a second duct means 32. The distal end 32*a* of second duct 32 has retaining means 50 attached thereto comprising spring clips 51, 53. The clips 51, 53 each have a clamping portion 51*a*, 53*a* securing the clips to the end 32*a* of the duct. The clips are made of spring steel and curve outwardly at 51*b*, 53*b* from clamping portion 51*a*, 53*a* to a U-shaped retaining portion 51*c*, 53*c*. Typically, the user will vent the exhaust via the air exhaust conduit 31 through a window so that the heated air does not heat up the area in which the dryer 10 is located. Accordingly, it may be necessary for the user to vent the air exhaust conduit 31 from either a first side 33, a second side 35, or a back side 37 of the cabinet 14. To afford this versatility, knockout plugs 12 are provided.

The knockout plugs 12 are located on a first side 33, second side 35, and back side 37 of the cabinet 14 allowing the consumer or service person to simply remove the plug from the side of the cabinet from which the consumer wants to vent the air exhaust conduit 31. Therefore the knockout plugs 12 provides a means for allowing the consumer to vent the air exhaust conduit 31 from a select side of the cabinet 14 while still affording a contiguous surface on the remaining sides of the cabinets.

Figure 4:
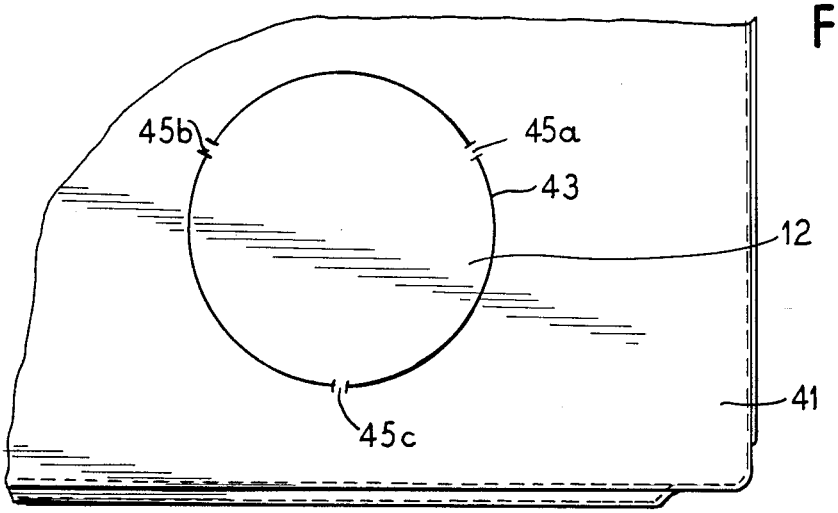
FIG. 4 illustrates step 1 of the method for creating the knockout plug of the present invention.
Figure 5:
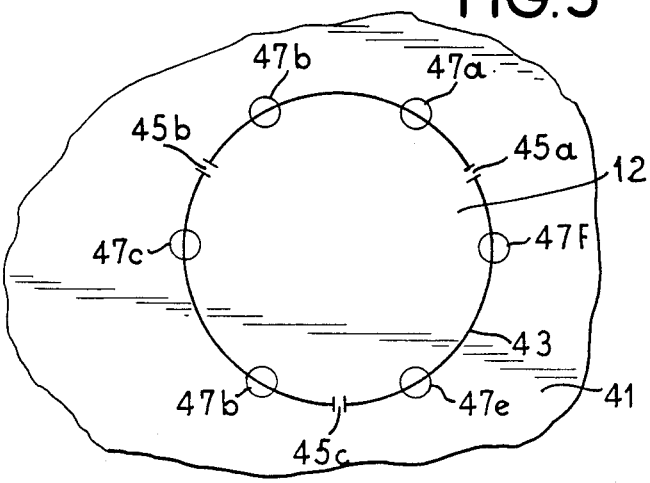
FIG. 5 illustrates step 2 of the method for creating the knockout plug of the present invention.
Figure 6:
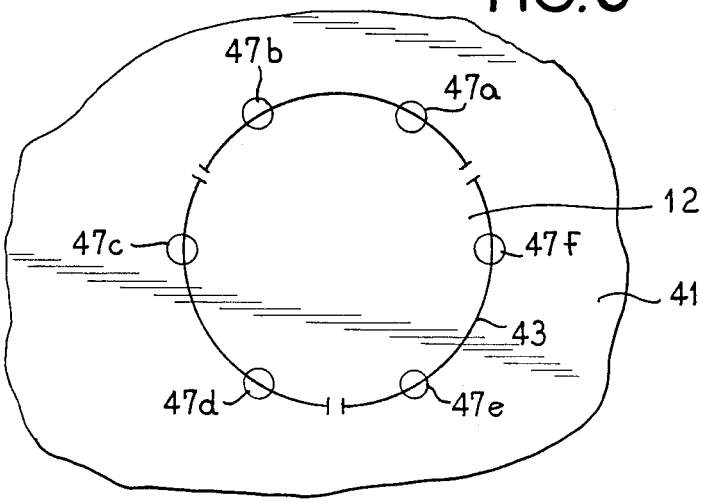
FIG. 6 illustrates step 3 of the method for creating the knockout plug of the present invention.

Referring now to FIGS. 4–6, the method for making the knockout plugs 12 will be described. Typically, the cabinet 14 is constructed from a metal casing constructed from sheet metal 41. To provide the knockout plugs 12, the sheet metal 41 is preferably stamped. In the first step of the process, the sheet metal 41 is stamped so that it is sheared along a majority of a perimeter of a geometric shape. Although, the knockout plug 12 is illustrated as being circular, if desired, other geometric shapes can be utilized. Preferably the knockout plug 12 will be circular because the air exhaust conduit 31 has a circular cross-sectional shape. Accordingly, as illustrated in FIG. 4, in the first step of the process the sheet metal is stamped so that it is sheared along the majority of the perimeter of a circle 43. To this end, retaining strips 45*a*, 45*b*, and 45*c* retain the knockout plug 12 to the remaining portions of the sheet metal 41.

Figure 7:
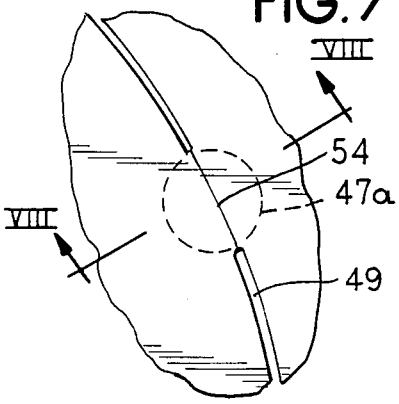
FIG. 7 illustrates a portion of the knockout plug of the present invention and specifically the area that has been cold worked.
Figure 8:
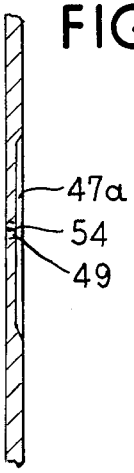
FIG. 8 illustrates a cross-sectional view of the cold worked area of the knockout plug taken along lines VIII—VIII.

In step 2 of the process, the sheet metal 41 is stamped again at predetermined areas along the sheared perimeter between the retaining strips 45*a*, 45*b*, and 45*c*. Specifically, the sheet metal 41 is cold worked at a plurality of areas 45*a*–47*f* along the sheared perimeter 43. Preferably, the areas 45*a–f* are cold worked by being stamped. The areas 45*a–f* are subjected to a localized pressure sufficient to preferably produce approximately 30 to about 50 percent cold working. As illustrated in FIGS. 7 and 8, this causes the original sheared gap 49 to be narrowed to a new gap 54 that is approximately 30 to about 50 percent smaller than the sheared gap 49. Accordingly, the sheet metal in areas 47*a–f* is cold worked to cause coalescence. As used herein "coalesce" or coalescense means that the sheared metal is moved together to the in frictional engagement.

After the areas 47*a–f* have been cold worked to reduce the sheared gap 49 in these areas, in step 3 of the process illustrated in FIG. 6, the retaining strip areas 45*a*, 45*b*, and 45*c* are sheared by stamping. Therefore, the knockout plug 12 is sheared along the entire circumference of the circle 43. However, the cold worked areas 47*a–f* function to retain the plug in the sheet metal.

This design and construction of the knockout plug 12 affords a plug that is easier to remove than conventional stamped steel vent plugs. Since the plug 12 has been fully sheared from the sheet metal the plug 12 can be removed by a force only sufficiently large to exceed the elastic limit of the steel. Because less force is required during removal, little or no damage will occur to the sheet metal 41, and accordingly to the cabinet 14, during removal of the plug 12. Moreover, the force required to remove the knockout plug 12 is variable and can be controlled by the number of cold worked areas 47*a–f*. Furthermore, the knockout plug 12 affords an advantage over typical plastic vent plugs in that the knockout plug 12 is constructed from the same sheet metal 41 as the remaining portions of the cabinet 14 and the knockout plug 12 and cabinet 14 can be painted as a unit.

Figure 3:
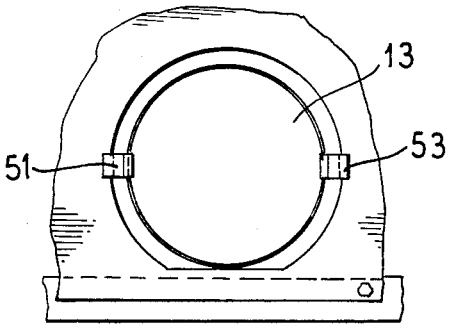
FIG. 3 illustrates the vent produced by the knockout plug of the present invention.
Figure 2:
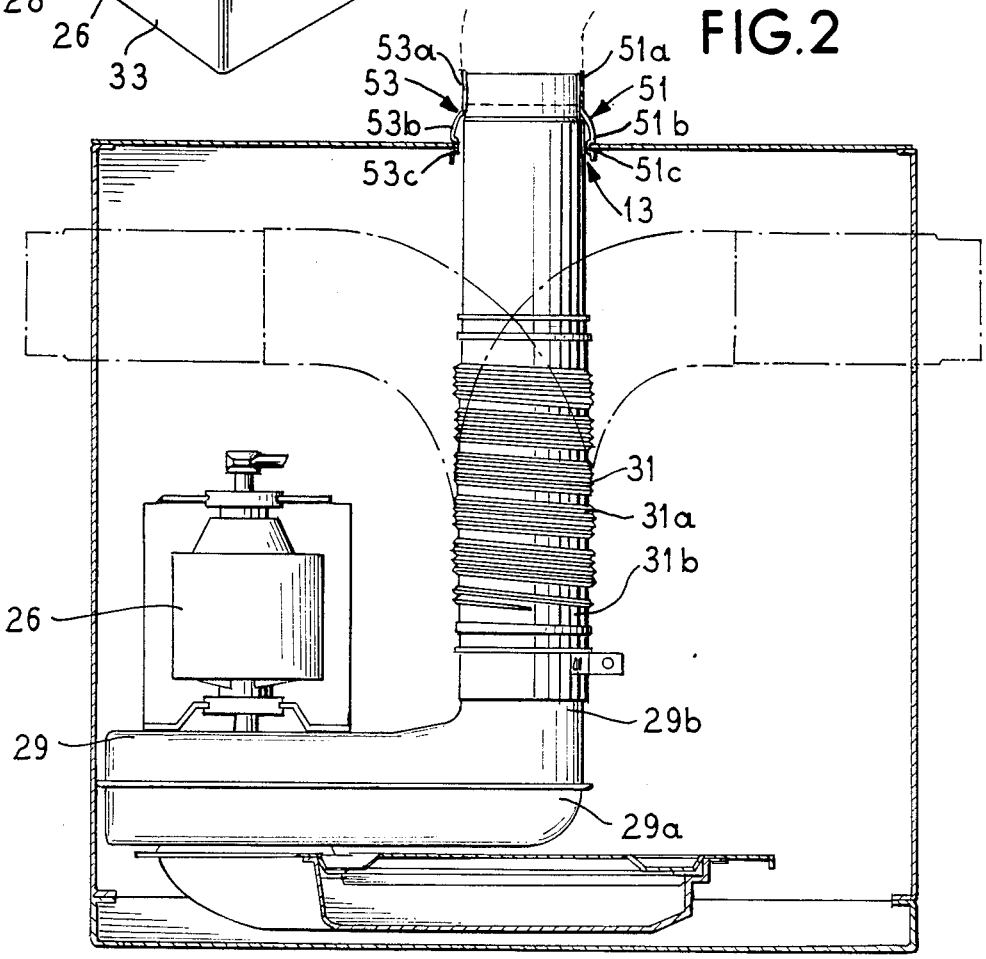
FIG. 2 illustrates a cross-sectional view of the dryer of FIG. 1 taken along lines II—II illustrating how the air exhaust conduit can be vented from either side or the back of the dryer.

Referring to FIG. 3, a vent aperture 13 produced after the knockout plug 12 has been removed is illustrated. As illustrated, the knockout plug 12 produces a circular vent aperture 13 that has a shape substantially similar to the cross-sectional circumference of the air exhaust conduit 31. Spring clips 51 and 53 secure the air exhaust duct 32 within the aperture 13 with sheet metal 41 fitting into U-shaped portions 51*c*, 53*c* of the clips.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A method of making a knockout plug in a sheet of metal comprising the steps of:

shearing the sheet metal along a majority of a perimeter of a geometric shape so that a plug is produced, retained to the sheet metal by at least one retaining strip;

cold working at least one sheared area at a pressure sufficient to cause the sheared sheet metal in the area to coalesce; and shearing the at least one retaining strip so that the sheet metal has been sheared along the entire perimeter of the geometric shape.

2. The method of claim 1 wherein the sheet metal is cold worked at a pressure sufficient to produce 30 to 50 percent cold working.

3. The method of claim 1 including the steps of: producing at least two retaining strips and cold working at least two sheared areas.

4. The product of the process of claim 1.

5. A method of making knockout plugs in a sheet of metal comprising the steps of:

shearing the sheet metal along the majority of a circumference of a circle to produce a gap between the sheared metal and leaving at least one retaining strip;

cold working an area along the sheared circumference at a pressure sufficient to cause the sheared metal to move together into frictional engagement in the cold worked area; and shearing the at least one retaining strip so that the sheet metal is sheared along the entire circumference of the circle.

6. The method of claim 5 including the steps of stamping the sheet metal to shear the sheet metal along a majority of the circumference of the circle, stamping the sheet metal to cold work the area and stamping the sheet metal to shear the retaining strip.

7. The method of claim 5 including the steps of shearing the sheet metal along the majority of the circumference of the circle to leave a plurality of retaining strips.

8. The method of claim 7 including the step of stamping a plurality of areas between the retaining strips to produce cold working.

9. The method of claim 5 wherein the area is cold worked at a pressure sufficient to produce approximately 30 to about 50 percent cold working.

10. The method of claim 7 including the steps of producing three retaining strips along the circumference of the circle and cold working six areas symetrically along the circle.

11. The product of the process of claim 5.

12. The product of the process of claim 9.

13. The product of the process of claim 10.

14. In an appliance having a metal casing and a knockout plug stamped in the casing for providing a vent opening in the casing the improvement comprising a knockout plug fully sheared along its entire perimeter and having an area along its perimeter as well as an abutting area along a perimeter of the opening that has been cold worked to produce coalescence between the sheared metal of the metal casing and the knockout plug.

15. The appliance of claim 14 wherein the knockout plug includes a plurality of cold worked areas.

16. The appliance of claim 14 including a plurality of knockout plugs.

17. The appliance of claim 14 wherein the knockout plug has circular shape.

18. The appliance of claim 14 wherein the appliance is a dryer and the knockout plug defines an opening sufficiently large for receiving an air exhaust conduit.

19. The appliance of claim 14 including a knockout plug on a first side of the appliance, a knockout plug on a second side of the appliance and a knockout plug on a back of the appliance.

* * * * *